United States Patent [19]

Venal et al.

[11] 3,982,925

[45] Sept. 28, 1976

[54] METHOD OF DECARBURIZATION IN ESR-PROCESSING OF SUPERALLOYS

[75] Inventors: Wilfredo V. Venal; H. Joseph Klein; Richard R. Daniel, all of Kokomo, Ind.; Rodney T. Gross, Lockport, N.Y.

[73] Assignee: Cabot Corporation, Kokomo, Ind.

[22] Filed: Apr. 9, 1975

[21] Appl. No.: 566,314

[52] U.S. Cl. ..... 75/10 R; 75/94

[51] Int. Cl.[2] ..... C22B 4/00; C22B 9/10

[58] Field of Search ..... 75/10 R, 94, 56

[56] References Cited

UNITED STATES PATENTS

| | | | |
|---|---|---|---|
| 2,374,396 | 4/1945 | Urban | 75/56 |
| 2,913,337 | 11/1959 | Kretz | 75/56 |
| 3,234,608 | 2/1966 | Peras | 75/56 |
| 3,905,804 | 9/1975 | Scott | 75/11 |

*Primary Examiner*—P. D. Rosenberg
*Attorney, Agent, or Firm*—Buell, Blenko & Ziesenheim

[57] ABSTRACT

A method of decarburizing ESR slags to reduce carbon pick up in superalloys is provided in which NiO is added to the slag prior to remelting the metallic electrode in amounts sufficient to reduce carbon in the slag to a desired level.

10 Claims, 4 Drawing Figures

Profile of Carbon Pickup in Molten 70F/15/0/15 in a Graphite Crucible Induction Furnace Profile of Carbon Pickup in Molten 100F/0/0/0 in a Graphite Crucible Induction Furnace Profile of Carbon Pickup in Molten 70F/15/0/15 in a Dual Electrode Arc Furnace.

Tentative Phase Diagram $CaF_2 - CaC_2$

METHOD OF DECARBURIZATION IN ESR-PROCESSING OF SUPERALLOYS

This invention relates to methods of decarburization or ESR slags and reduction of carbon pick up in superalloys and particularly to the decarburization of ESR slag with NiO.

The control of carbon to very low levels is critical especially in corrosion resistant alloys, particularly nickel and cobalt base alloys, such as "Hastelloy"* alloy B, "Hastelloy" alloy C, "Hastelloy" alloy C-276 and "Hastelloy" alloy C-4, to prevent weld heat-affected zone corrosion. It has been recognized for some time that the precipitation of grain boundary carbides in the weld heat-affected zone of such alloys is the principal source of preferential, in-situ corrosion attack in as-welded material of this type.

*Hastelloy is a trademark of Cabot Corporation.

We have found that one of the principal sources of carbon pick up in these alloys is the molten slag used in conventional ESR (electro-slag remelting) practices. These slags, which are generally calcium-fluride based, are conventionally melted in a carbon crucible prior to addition to the ESR mold for molten slag start of remelting. A significant amount of carbon appears in the slag as melted and at the time of addition to the mold. This carbon is at least in part transferred to the ingot which is remelted throughout, particularly the butt or bottom portion. Typical of the calcium fluoride slags used for this type of practice are 70F/15/0/15 and 100F/0/0/0 ($CaF_2/CaO/MgO/Al_2O_3$ ratio) slags. All compositions are given in percent by weight unless otherwise stated.

We have found that this problem of carbon pick up can be eliminated by the addition of NiO to the slag prior to remelting the superalloy. Preferably we add the NiO to the molten slag just prior to adding it to the ESR mold and then pouring the mixture into the mold. However, the NiO may be added to the stream of molten slag as it is poured into the mold or it may be added to the starting chips in the bottom of the mold prior to adding the molten slag or any combination of these methods may be used, e.g. part in the chips and part in the slag. This causes oxidation of the carbon and its evolution as volatile oxides of carbon (CO and $CO_2$). Where it is desired to prevent oxidation of highly oxidizable materials such as Ti from the metal, the addition of Al to the mold bottom prior to adding the treated molten slag will protect such materials.

It is well known in the art that many other additions may be used as deoxidants, for example, silicon, titanium, Ni-Mg, Ca-Si, one or more elements in the Rare Earths Series, misch-metal and the like. One or more of these deoxidant additions may be used together with or in place of aluminum. The choice of deoxidant is not critical in practice of this invention.

This invention can perhaps best be understood by reference to actual application of our method to remelt practice and to the accompanying drawings in which.

EXAMPLE I

Figure 1:
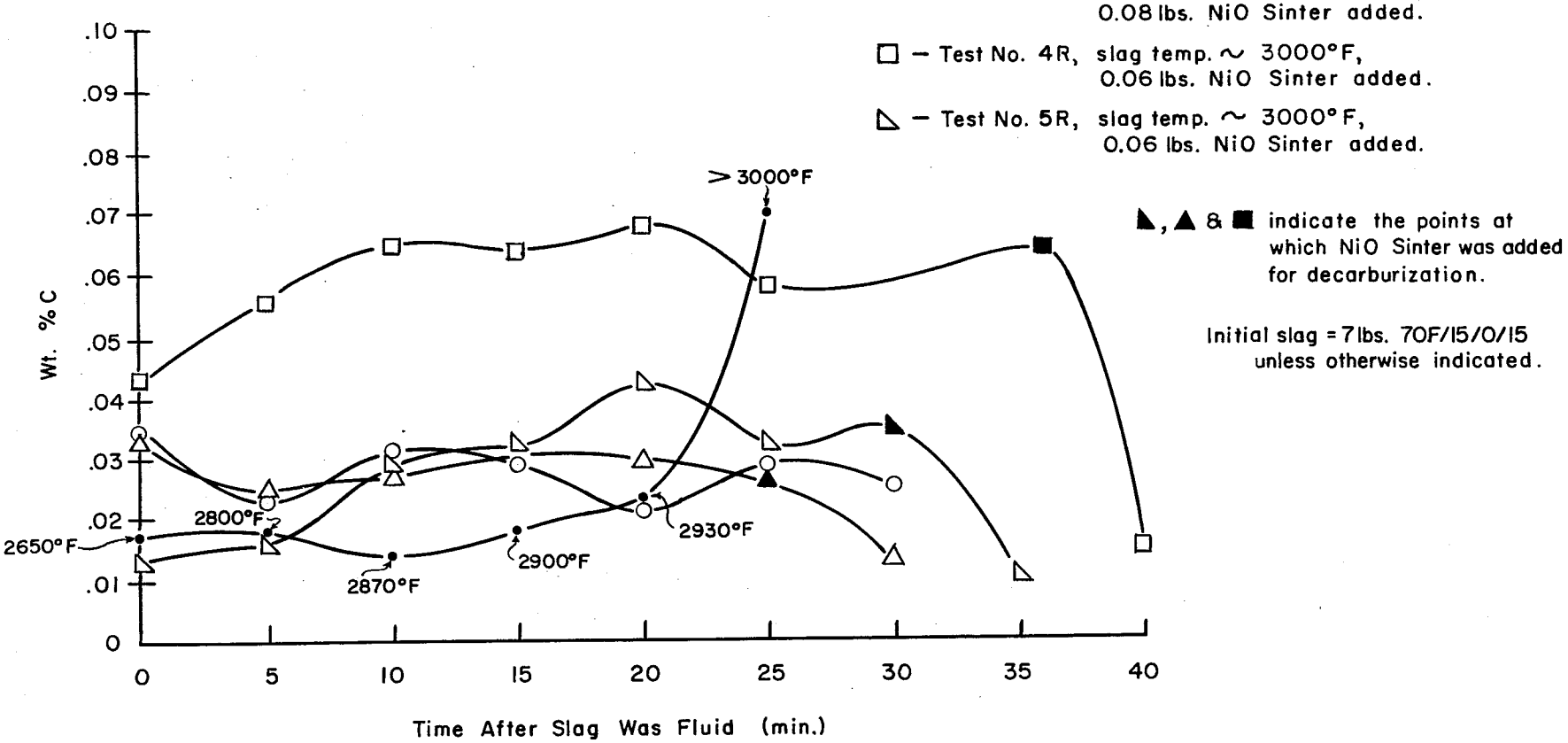
FIG. 1 is a graph of carbon content versus time of fluidity in 70F/15/0/15 slag.

A slag of composition 70F/15/0/15 was melted in a graphite crucible induction furnace. The total amount of slag was seven pounds. Samples were taken from the slag at five minute intervals for a total of 30 minutes and the carbon pick up determined. NiO sinter was added to the slag to react with the carbon dissolved in the slag. The results are tabulated in Table I.

EXAMPLE II

A seven pound slag of composition 100F/0/0/0 was treated precisely as in Example I. The results are tabulated in Table I.

EXAMPLE III

One hundred sixty (160) pounds of a slag of composition 70F/15/0/15 was prepared in a dual electrode arc furnace. Again the profile of carbon pick up was determined by chemical analysis after which NiO sinter was added stepwise and the decarburization effect determined. The results are tabulated in Table I.

TABLE I

RESULTS OF SLAG DECARBURIZATION EXPERIMENTS USING NiO SINTER

| Test No. | %C Before Decarb. | %C After Decarb. | Lbs. NiO/ Lbs. Slag | % Reduction |
|---|---|---|---|---|
| Slag Type 70F/15/0/15 | | | | |
| Dual Electrode Arc Furnace (Example III) | | | | |
| 2V | .05 | .03 | .018 | 40 |
| 3V | .26 | .02 | .020 | 92 |
| 4V | .33 | .02 | .020 | 94 |
| Graphite Crucible Induction Furnace (Example I) | | | | |
| 3R | .026 | .013 | .011 | 50 |
| 4R | .064 | .015 | .008 | 77 |
| 5R | .034 | .010 | .008 | 70 |
| 10R | .042 | .020 | .008 | 52 |
| Slag Type 100F/0/00 | | | | |
| Graphite Crucible Induction Furnace (Example II) | | | | |
| 6R | .045 | .029 | .011 | 36 |
| 7R | .042 | .026 | .008 | 38 |
| 11R | .063 | .032 | .008 | 49 |

EXAMPLE IV

A 70/15/0/15 slag was melted as in Example III. Two heats of 7 lbs. each were melted without any decarburization treatment and a third 7 lb. heat decarburized using NiO sinter as in Example III. A 4½ inch diameter electrode of "Hastelloy" alloy C-276 having the analysis set out in Table II was remelted into a 6 inch ingot using each of these slags. Analysis of the slag and resulting ingot are tabulated in Table III.

TABLE II

COMPOSITION OF STARTING "HASTELLOY" ALLOY C-276 ELECTRODE

| Element | Percent by Weight |
|---|---|
| Al | 0.23 |
| B | < 0.001 |
| C | 0.006 |
| Ca | < 0.005 |
| Co | 1.09 |
| Cr | 16.15 |
| Cu | < 0.01 |
| Fe | 5.29 |
| Mg | 0.018 |
| Mn | 0.55 |
| Mo | 15.97 |
| N | .007 |

TABLE II-continued

| COMPOSITION OF STARTING "HASTELLOY" ALLOY C-276 ELECTRODE | |
|---|---|
| Element | Percent by Weight |
| Ni plus incidental impurities | Balance about 55.0 |
| P | 0.013 |
| S | 0.002 |
| Si | 0.03 |
| Ti | < 0.01 |
| V | 0.22 |
| W | 3.78 |
| Zr | < 0.01 |

graphite powder added between the two electrodes to start the furnace. The graphite powder alone could result in 0.15% C pick-up by the slag — thus, the difference in absolute carbon levels between Examples I and II and those of Example IV. In all probability, carbon in a halide based slag such as 70F/15/0/15 and 100F/0/0/0 is present as $CaC_2$. This assumption is based primarily on the peculiar odor of $CaC_2$ which can be easily detected in all of the slag samples.

Figure 4:
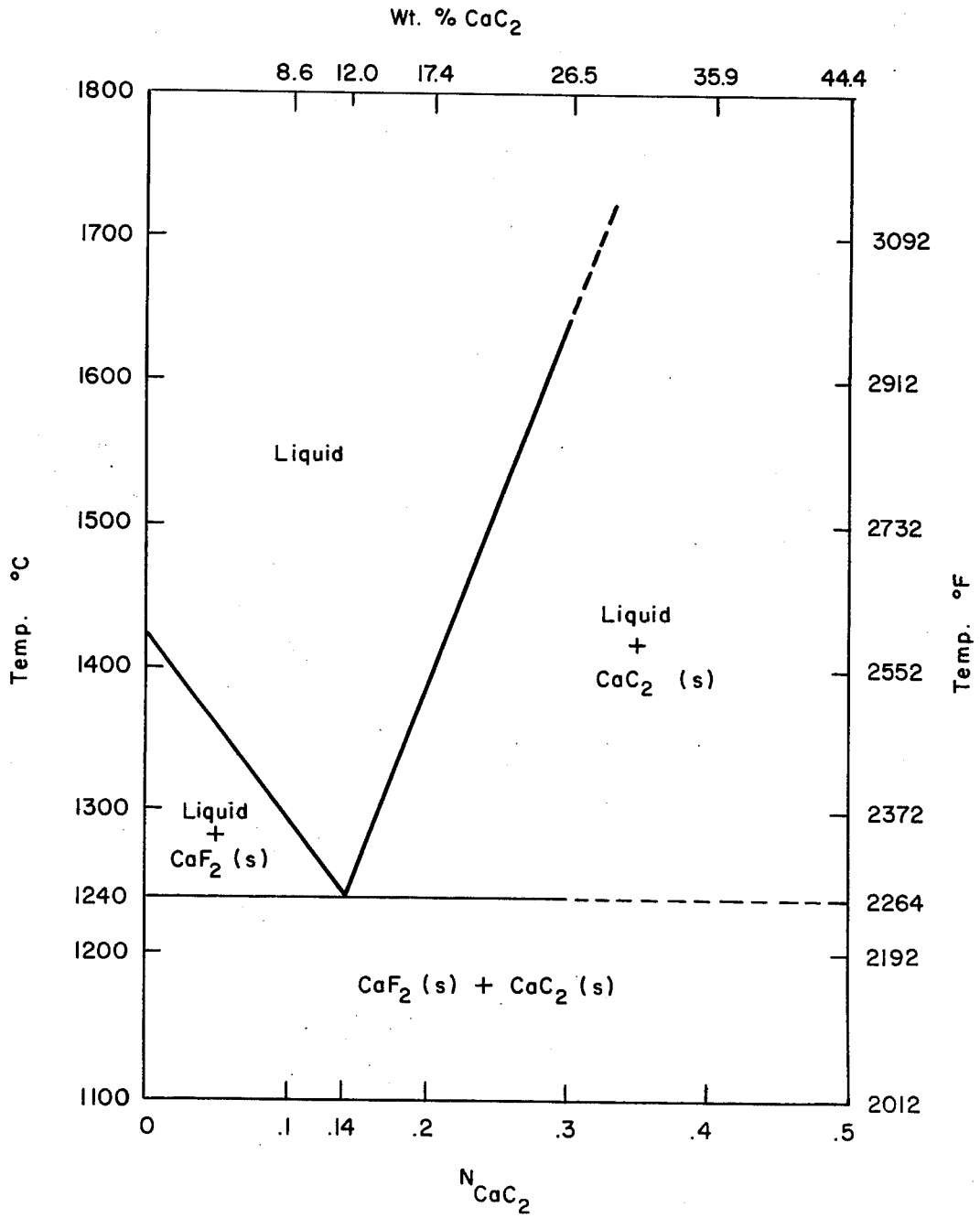
FIG. 4 is a phase diagram of the system $CaF_2$-$CaC_2$.

The tentative phase diagram for the system $CaC_2$ in $CaF_2$ is shown in FIG. 4. This diagram shows a potential maximum carbon solubility of 10.5% at 1600°F. Thus, it would appear that at the carbon levels here encountered all of the carbon is in solution even though the slag actually used is a ternary $CaF_2$-CaO-$Al_2O_3$ system.

TABLE III

RESULTS OF EXPERIMENTS USING DECARBURIZED 70F/15/0/15 SLAG
Voltage 30 - Amperage 2000

| Test No. | %C Slag Before Decar. | %C Slag After Decar. | %C Slag After ESR | %C Electrode | %C Ingot* B1 | %C Ingot* B2 | %C Ingot* HT |
|---|---|---|---|---|---|---|---|
| 8R control electrode, slag not decarb., 42.4 lb. (~19.3 kg) ESR ingot | .042±.02 | — | 0.32±.02 | .006±.003 | .009±.003 | .005±.002 | .004±.002 |
| 14R control electrode, slag not decarb., 36 lb. (~16.3 kg) ESR ingot | .076±.03 | — | .021±.02 | .006±.003 | .035±.005 | .023±.005 | .017±.005 |
| 10R slag decarburized with .06 lb. NiO, 48.5 lb. (~22 kg) ESR ingot | .042±.02 | .020±.02 | .016±.02 | .006±.003 | .003±.002 | .004±.002 | .004±.002 |

*B1 samples are the very butt end of the ingot except for some material that is ground off to make the surface of the X-ray slug flat. B2 samples are the opposite face of the slag sample which is about ⅞ inch (19 to 25 mm) thick. HT are hot top samples.

EXAMPLE V

A 100/0/0/0 slag was melted as in Example III. Again a 7 lb. heat was melted without decarburizing and a second 7 lb. heat was decarburized using NiO sinter as in Example III. A series of 4½ inch diameter electrodes of "Hastelloy" alloy C-276 having the analysis set out in Table II were remelted into a 6 inch ingot using electroslag remelting (ESR) techniques using each of these slags. Analysis of the slags and the resulting ingots are tabulated in Table IV.

Figure 2:
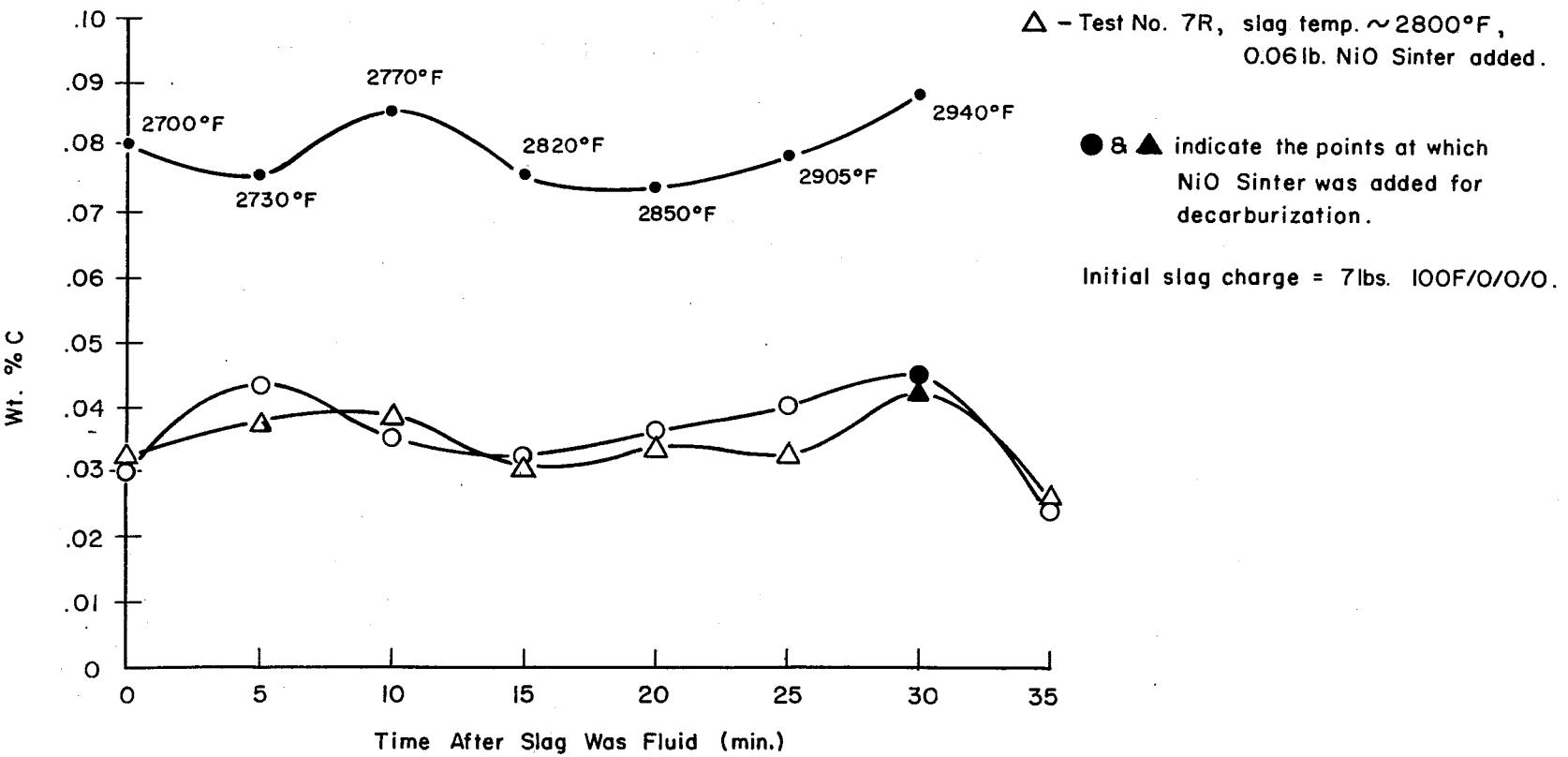
FIG. 2 is a graph of carbon content versus time of fluidity in 100F/0/0/0 slag.

FIG. 2 shows no appreciable difference in carbon pick-up for molten 100F/0/0/0 at 2800°F and 3000°F as would be expected from the tentative phase diagram $CaF_2$–$CaC_2$ (FIG. 4). However, results of tests using 70F/15/0/15 (FIG. 3) indicate higher levels of carbon pick-up at 3000°F compared to those at 2800°F. In fact, test IV which was run according to a standard practice for slag showed a dramatic increase in slag carbon content from 0.03%C at 2750°F to 0.26% at >3200°F. (Note: Slag temperature is raised prior to top pouring into the ESR mold for molten slag start). Although not as compellingly evident, the same phenomenon was observed in the experiments using 70F/15/0/15 run in the graphite crucible induction furnace. Tests 2R and 4R (FIG. 1) run at 3000°F exhibited approximately the same carbon levels as those in Test 3R at 2800°F. However, Test 4R also at 3000°F had carbon levels well above those of the rest. In addition, Test 1AR which was run to simulate a standard practice, i.e., slag temperature not controlled and raised to >3000°F prior to pouring, showed a similar increase in carbon content as in Test IV. Of course, in these runs using 70F/15/0/15, we are dealing with the quaternary system $CaF_2$-CaO-$Al_2O_3$-$CaC_2$ where the solubility of carbon might be different compared to the simple $CaF_2$-$CaC_2$ binary. Moreover, there is an indication from these experimental results that the kinetics of

TABLE IV

RESULTS OF EXPERIMENTS USING DECARBURIZED 100F/0/0/0 SLAG
Voltage 30 - Amperage 2400

| Test No. | %C Slag Before Decar. | %C Slag After Decar. | %C Slag After ESR | %C Electrode | %C Ingot* B1 | %C Ingot* B2 | %C Ingot* HT |
|---|---|---|---|---|---|---|---|
| 9R control electrode, not decarb., 48 lbs. (~21.8 kg) ESR ingot | 0.42±.02 | — | .035±.02 | .006±.003 | .005±.002 | .002±.002 | .008±.003 |
| 11R slag decarburized with .06 lb. NiO 48.5 lb. (~22 kg) ESR ingot | .063±.03 | .032±.02 | .040±.02 | .006±.003 | .005±.002 | .005±.002 | .002±.002 |

*Same comments as in Table III.

Figure 3:
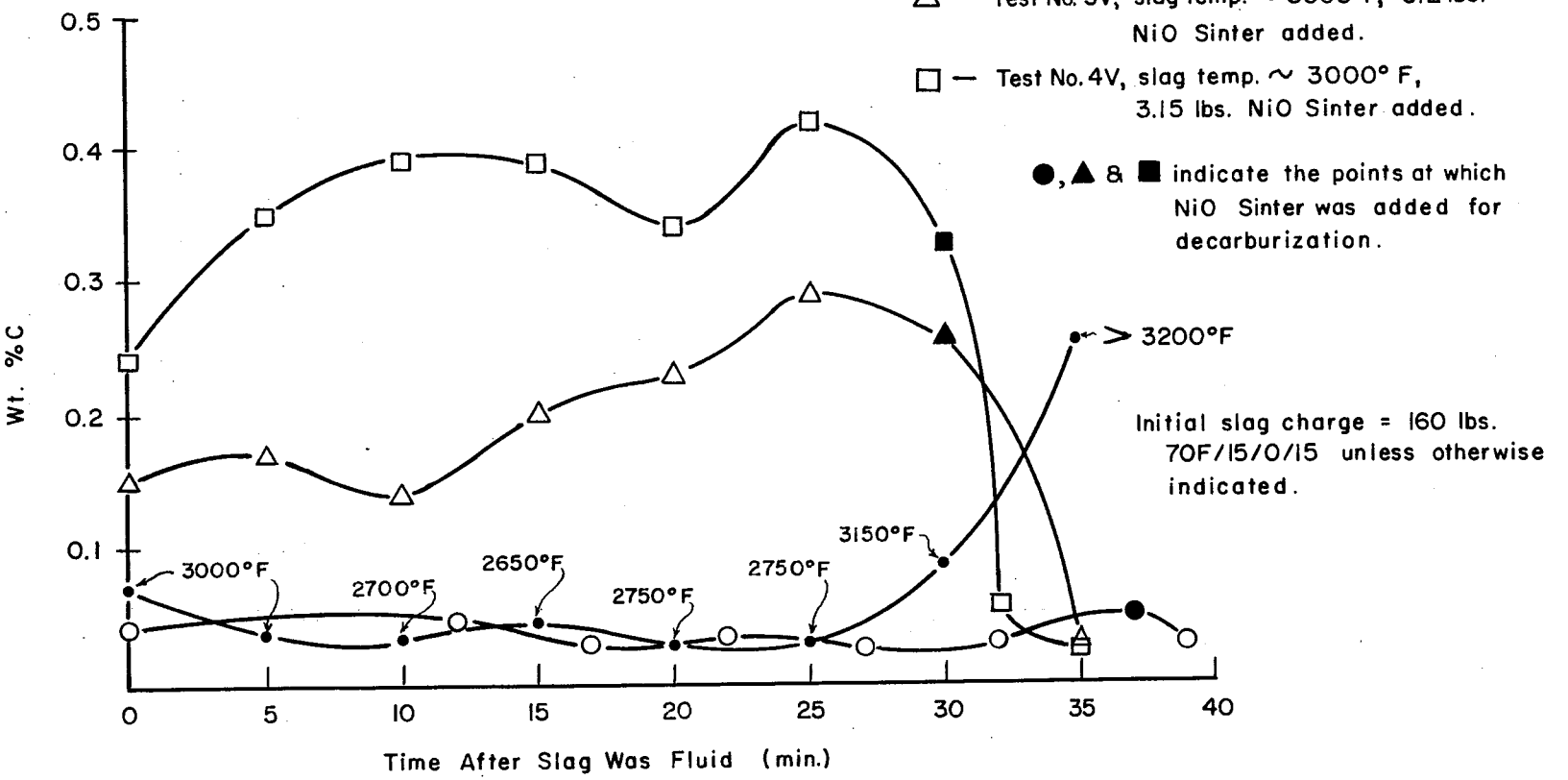
FIG. 3 is a graph of carbon content versus time of fluidity in 70F/15/0/15 slag in a dual arc furnace.

In FIGS. 1, 2 and 3, the experimental points are connected together for illustrative purposes and does not necessarily represent any functional relationship between %C and time. Temperatures were measured by an optical pyrometer which in some cases was cross-checked with immersion thermocouples. FIGS. 1 and 2 graphically show the change in carbon content of molten 70F/15/0/15 and 100F/0/0/0, respectively, in the graphite crucible induction furnace (Examples I and II). The source of carbon for Examples I and II is the graphite crucible plus whatever amount of graphite and in some cases $CaC_2$ that is intentionally added for a desired initial carbon level prior to decarburization. On the other hand, for runs made at the arc furnace (Table III), carbon could be picked up by the slag from the two electrodes and the graphite furnace shell as well as from the approximately 0.25 pound (~0.114 kg)

carbon pick-up in $CaF_2$ based slag systems is temperature dependent.

The most significant results that could be gathered from FIGS. 1, 2 and 3 are the favorable extent to which slag decarburization could be carried out using NiO sinter addition. Table I summarizes the results of the slag decarburization experiments using NiO sinter.

In the series of tests described in Examples IV and V above NiO decarburized slag was used in ESRemelting a 4½-½-inch diameter (~108 mm diameter) alloy C-276 electrode into a 6-inch diameter (~152 mm diameter) ingot. The composition of the starting alloy C-276 electrode is shown in Table 2. The results for 70F/15/0/15 and 100F/0/0/0 are shown in Tables 3 and 4, respectively. Table 3 shows once again the effectiveness of using an NiO sinter decarburized slag in ESRemelting "HASTELLOY" alloy C-276 without causing carbon pickup in the ingot. A carbon balance for Tests 10R and 12R (Table 3) indicate a net loss of ~0.51 gm and ~0.87 gm carbon, respectively, during ESRemelting without causing an increase in slag carbon content. A possible explanation for this is that residual NiO might have caused further oxidation of carbon in both the electrode and the slag during ESR.

A carbon balance for Tests 11R and 13R (Table 4) indicates a net loss of ~0.44 gm and ~0.47 gm which could all be accounted for in the increase of the slag carbon content after remelting. This would indicate the apparent capability of 100F/0/0/0 to keep a greater amount of carbon in solution compared to 70F/15/0/15 an implication of a possibly greater carbon solubility in pure $CaF_2$ than in the ternary system $CaF_2$-CaO-$Al_2O_3$.

In the foregoing specification we have set out certain presently preferred practices and embodiments of our invention; however, it will be understood that this invention may be otherwise practiced within the scope of the following claims.

We claim:

1. The method of electroslag remelting of nickel and cobalt base alloy materials to prevent weld heat affected zone corrosion resulting from precipitation of grain boundry carbides in such alloys comprising the step of decarburizing the ESR starting slag by adding a sufficient amount of NiO to the molten slag to react with sufficient carbon to evolve volatile oxides of carbon and reduce the carbon in the slag to the desired level prior to starting the remelting of the alloy material.

2. The method as claimed in claim 1 wherein the NiO is in the form of a sinter product.

3. The method as claimed in claim 1 wherein the NiO is added to the slag in the vessel in which said slag is melted.

4. The method as claimed in claim 1 wherein the NiO is added to the slag as it is poured into an ESR mold.

5. The method as claimed in claim 1 wherein at least a part of the NiO is placed in an ESR mold prior to introducing the molten slag into said mold.

6. The method of electroslag remelting of alloys comprising the steps of:

a. melting a slag in a melting vessel;

b. transferring said slag to an ESR mold;

c. treating the slag in at least one of steps (a) and (b) with sufficient amount of NiO to react with carbon to evolve volatile oxides of carbon and reduce the carbon in the slag to a desired level prior to starting the remelting of the metallic electrode; and d. remelting a metallic electrode in said ESR mold through said molten slag.

7. The method as claimed in claim 6 where at least one of the group consisting of aluminum, silicon, titanium, Ni-Mg, Ca-Si, one or more elements in the rare earth series and misch-metal is added to the ESR mold prior to transferring the slag into the mold.

8. The method as claimed in claim 6 where Al is added to the ESR mold prior to transferring the slag into the mold.

9. The method as claimed in claim 6 wherein the NiO is in the form of NiO sinter.

10. The method as claimed in claim 1 wherein the molten slag is a $CaF_2$ based slag from the group consisting of 70/15/0/15 and 100/0/0/0 slags.

* * * * *